United States Patent [19]

Kodama et al.

[11] Patent Number: 4,498,283

[45] Date of Patent: Feb. 12, 1985

[54] APPARATUS FOR LOCATING A TRAVELING-TYPE SERVICING DEVICE IN A MULTISTATION TEXTILE MACHINE

[75] Inventors: Ikuo Kodama, Toyoda; Shigeru Muramatsu, Okazaki; Kazunori Terasaki; Takayuki Morita, both of Kariya, all of Japan

[73] Assignee: Seisakusho Kabushiki Kaisha Toyoda Jidoshokki, Kariya, Japan

[21] Appl. No.: 465,538

[22] Filed: Feb. 10, 1983

[30] Foreign Application Priority Data

Feb. 12, 1982 [JP] Japan ..... 57-021857

[51] Int. Cl.[3] ..... D01H 9/14; D01H 15/00

[52] U.S. Cl. ..... 57/261; 57/263; 57/268; 57/276; 57/277; 57/301; 57/304; 57/411; 242/35.5 R; 242/35.5 A

[58] Field of Search ..... 57/261-263, 57/301-305, 411, 415, 266, 268-277; 242/35.5 R, 35.5 A

[56] References Cited

U.S. PATENT DOCUMENTS

| | | | |
|---|---|---|---|
| 3,827,226 | 8/1974 | Lesser | 57/261 |
| 4,038,812 | 8/1977 | Stahlecker | 57/411 X |
| 4,102,115 | 7/1978 | Hemala et al. | 57/261 |

*Primary Examiner*—John Petrakes

*Attorney, Agent, or Firm*—Brooks Haidt Haffner & Delahunty

[57] ABSTRACT

An apparatus for locating a servicing device which travels along a parent textile machine, such as a spinning frame, having a plurality of stations and stops at any designated station of the parent machine to there perform a servicing operation, such as yarn piecing or cleaning by use of fluid, such as compressed air or vacuum, supplied from a fluid source provided separately from the servicing device. The apparatus comprises, on each station of the parent machine, a stationary connector communicating with the fluid source and a locating guide member having a locating guide groove therein, and, on the servicing device, an air cylinder, a locating rod actuated by the cylinder toward and away from the locating guide member and engageable with the guide groove and a communicating member movable together with the locating rod and engageable with the stationary connector. In operation, the connectors are coupled to establish a communication between the fluid source and the servicing device after the locating rod has engaged with the guide groove thereby to locate the servicing device correctly. Because the locating rod and the communicating member are moved substantially in an integral manner by a single actuator, accurate and reliable locating of the servicing device may be accomplished.

11 Claims, 9 Drawing Figures

APPARATUS FOR LOCATING A TRAVELING-TYPE SERVICING DEVICE IN A MULTISTATION TEXTILE MACHINE

BACKGROUND OF THE INVENTION

The present invention relates generally to an apparatus for locating a servicing device which can travel along a parent textile machine having an array of stations and provides a servicing operation at any designated station. More specifically, it relates to an apparatus for locating a servicing device which is movable along a parent multi-station textile machine, such as a spinning frame having a plurality of spinning stations or units, and stops at any designated station of the parent machine, when so called upon, to there perform a servicing operation such as yarn piecing, package doffing or cleaning by use of a fluid medium such as compressed air or vacuum.

In a textile machine such as a spinning frame, a twisting machine or the like having a plurality of stations arranged on both sides thereof in a side-by-side relation, the servicing operation such as yarn piecing, package doffing or cleaning at each of such stations has been mechanized for the purpose of labor saving to such an extent that it may be performed automatically. A servicing device which can travel along its parent textile machine and is adapted to provide such servicing operation is required to make an accurate positioning stop at a specified point in each of the stations.

As the medium for servicing, fluid such as compressed air or vacuum is very often utilized for accomplishing various jobs in servicing operation, but the servicing device itself usually includes no built-in source of such fluid, such as a compressor or a blower. As a method for the servicing device to take in necessary fluid, it is known that a communication is established between the servicing device which is located at a given position in any station of the parent machine and a stationary supply source of fluid which is provided separately from the servicing device.

In such a known arrangement, two separate actuators, e.g. air cylinders, are employed by the servicing device; one for locating the servicing device at a position in station and the other for moving a communicating member provided on the servicing device toward the fluid supply source thereby to establish a communication therebetween. Such an arrangement of separate actuators for different jobs exhibits disadvantages in that coupling of connectors for establishing a communication cannot be made in a reliable way, that a considerable length of time is required before the servicing device starts to operate after a stop thereof at a designated station, and also that maintenance of the servicing device is difficult and time-consuming because of its complicated structure.

SUMMARY OF THE INVENTION

The present invention is directed to solving the above-mentioned disadvantages and drawbacks. Therefore, the object of the invention is to provide an apparatus according to which a servicing device may be located properly with respect to each of the stations of a parent textile machine and simultaneously a coupling of the connectors for making a communication of fluid such as compressed air or vacuum between the supply source and the servicing device may be performed in an accurate and reliable way.

It is another object of the invention to provide an apparatus which is simple in construction and therefore easy to maintain.

The above and other objects, features and advantages of the present invention will become more apparent to those skilled in the art from the following detailed description of a preferred embodiment of the invention, taken in conjunction with the accompanying drawings, wherein:

DETAILED DESCRIPTION OF PREFERRED EMBODIMENT

The following will explain in detail a preferred embodiment of apparatus of the invention, on a specific supposition that compressed air is to be supplied to the servicing device, with reference to FIGS. 1 to 6.

Figure 1:
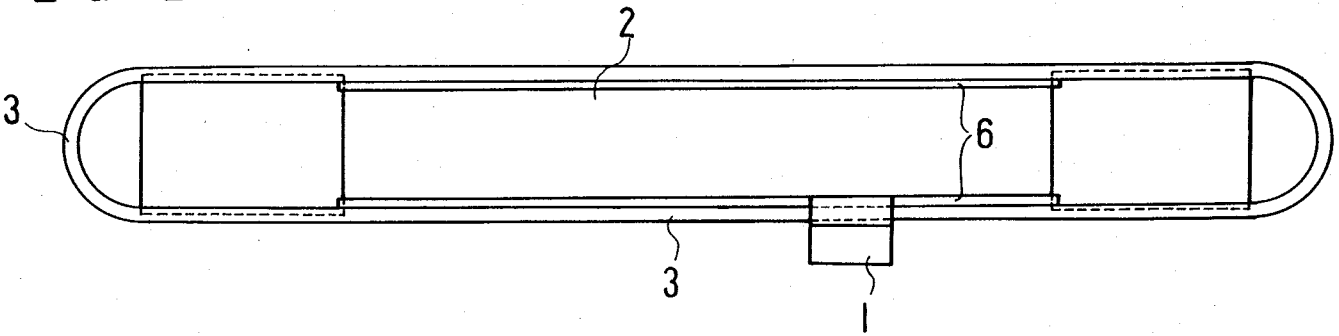
FIG. 1 is a schematic plan view of an embodiment of apparatus according to the present invention.
Figure 2:
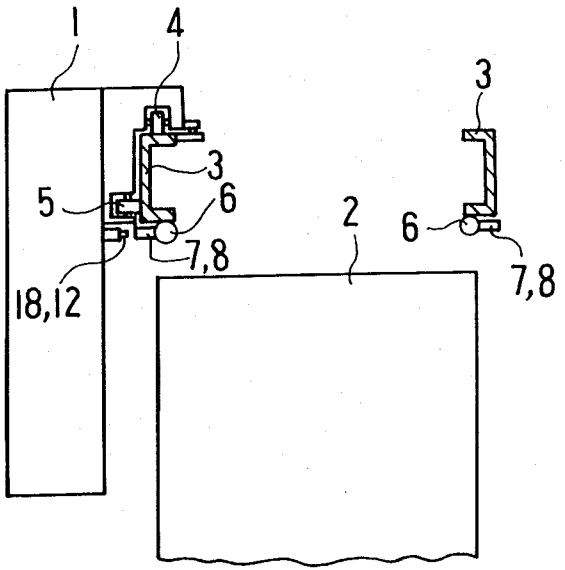
FIG. 2 is a side view showing how a servicing device is supported movably.
Figure 3:
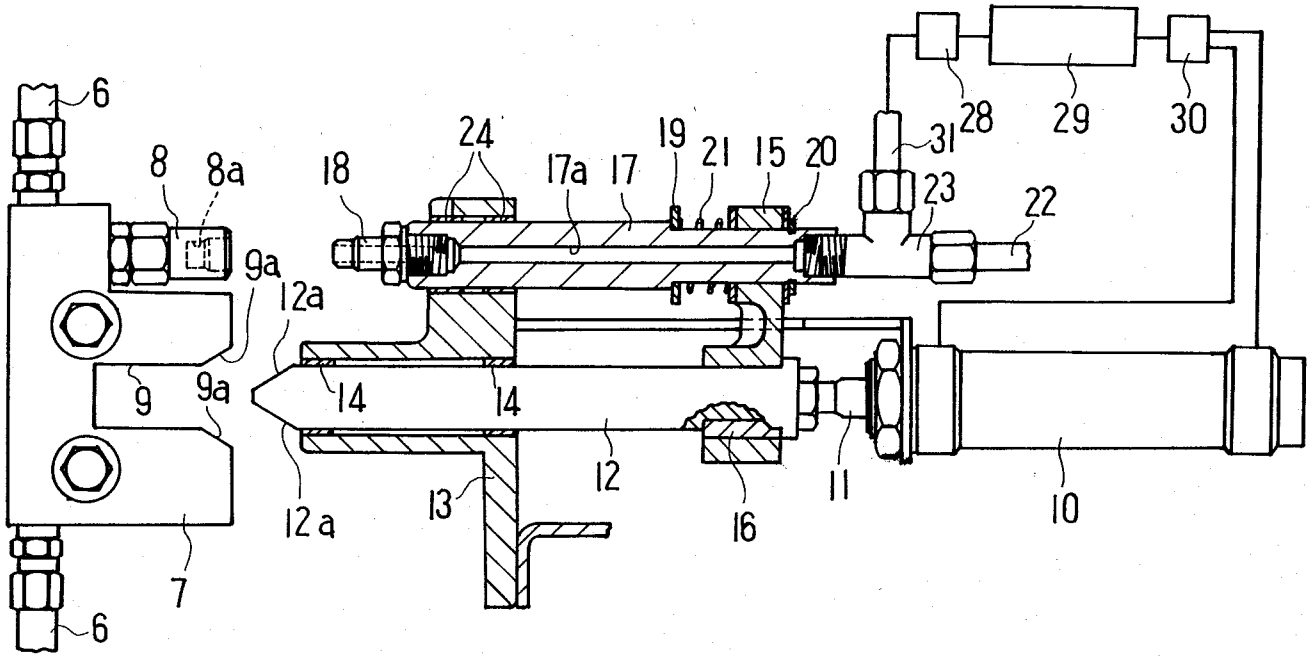
FIG. 3 is a partially cutaway plan view showing the details of a preferred embodiment of apparatus according to the invention.

A textile machine 2, e.g. a spinning frame, comprises a series of spinning stations or spinning units (not shown) arranged on both sides thereof, and a servicing device 1 is supported via drive rollers 4 and guide rollers 5 by a carrier rail 3 which is disposed around the parent textile machine 2 so that the servicing device 1 may travel along both sides of the parent machine 2, and therefore between the individual stations thereof. Supply pipes 6 connected to any source of compressed air are mounted on the carrier rail 3 so as to extend along the stations on both sides of the machine 2. Below the carrier rail 3 are disposed a plurality of locating guide units 7 and stationary connectors 8 communicating with the interior of the compressed air supply pipe 6 for the respective stations at intervals corresponding to the spindle pitch or the station-to-station distance of the parent machine 2. The locating guide unit 7 is formed into a channel shape in plan view as shown in FIG. 3, having a locating guide groove 9 formed therein with tapered portions **9*a* diverging outwardly. The stationary connector 8 is provided adjacently of the locating guide unit 7, and has a recess 8*a*** formed therein into which a mating movable connector, which will be explained later, fits.

An air cylinder 10 is fixedly mounted in the servicing device 1 at a level which is substantially equal to that of the locating guide unit 7. The cylinder 10 has a piston rod 11 protruding therefrom and operable toward and away from the locating guide unit 7. A locating rod 12 is fixedly connected at one end thereof to the piston rod 11 and slidably supported via bearings 14 by and through a guide bracket 13 which is fixed to the servicing device 1. The opposite free end of the locating rod 12 is formed with a tapered portion 12*a* having substantially the same angle of taper as the tapered portions 9*a* of the locating groove 9.

A supporting bracket 15 is fixed on the base end of the locating rod 12 adjacent the piston rod 11 by means of a key 16 and, therefore, movable together with the piston rod 11 and the locating rod 12. The supporting bracket 15 slidably supports the base end of a communicating member 17 having a plug connector 18 screwed into the opposite end thereof and engageable with the recess 8*a* of the connector 8 and also an axial passageway 17*a* formed therethrough. There are two flanges 19 and 20 mounted on the base end of the communicating member 17 in a spaced relation with the supporting bracket 15 therebetween, and a compression spring 21 is installed also on the base end of the communicating member 17 and retained by and between the supporting bracket 15 and the flange 19 provided on the side which is closer to the plug connector 18, in such a way as to urge the communicating member 17 toward the connector 8 provided on the parent machine 2. Furthermore, the communicating member 17 has at the base end thereof a T-joint pipe 23 which is connected at one outlet port thereof with a flexible tube 22 which is in turn connected to any pneumatic devices (not shown) in the servicing device 1, and at the other outlet port thereof with another flexible tube 31 which is further connected to a reservoir 29 for compressed air by way of a check valve 28. On the opposite side of the air reservoir 29, a solenoid-operated direction control valve 30 is provided which allows the compressed air in the reservoir 29 to flow through either of the lines extending between the valve 30 and opposite ends of the cylinder 10, thereby controlling the direction in which the piston rod 11 is operated. Like the locating rod 12, the communicating member 17 is slidably supported by and through the guide bracket 13 via bearings 24.

Operation of the above-illustrated apparatus will now be explained:

When the servicing device 1 receives from any of the spinning stations of the parent machine 2 a signal calling for servicing operation, such as yarn piecing or cleaning, at the designated station by the servicing device 1, it is brought to that station and brake is applied in a known way to stop it at an approximate stop position for the station. Then, brake is once released to permit the subsequent step of locating the servicing device 1, which is described hereafter.

Figure 4:
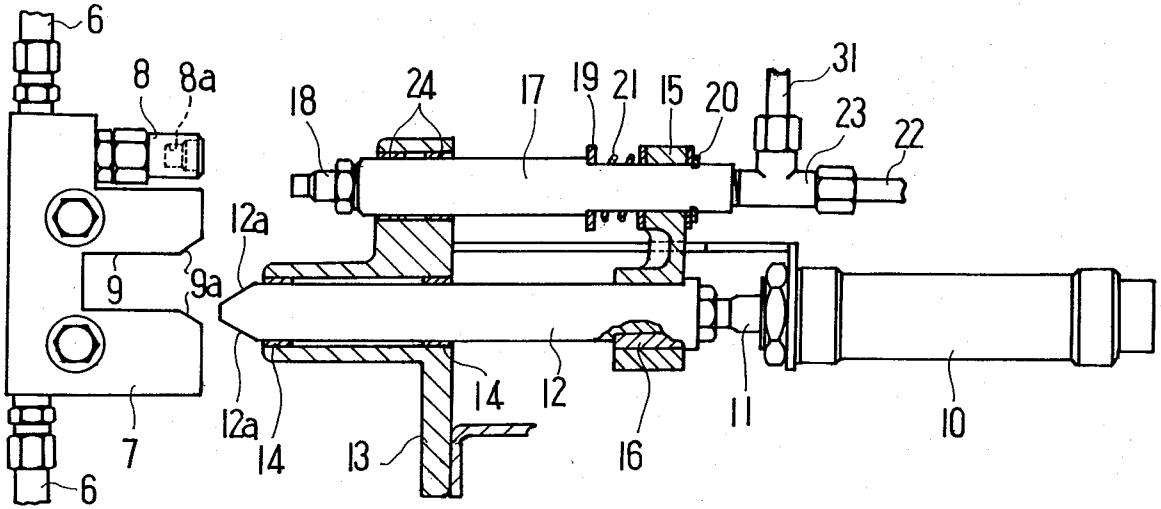
FIGS. 4 to 6 are similar to FIG. 3, but showing three different phases of operation of the preferred embodiment of apparatus according to the invention.
Figure 5:
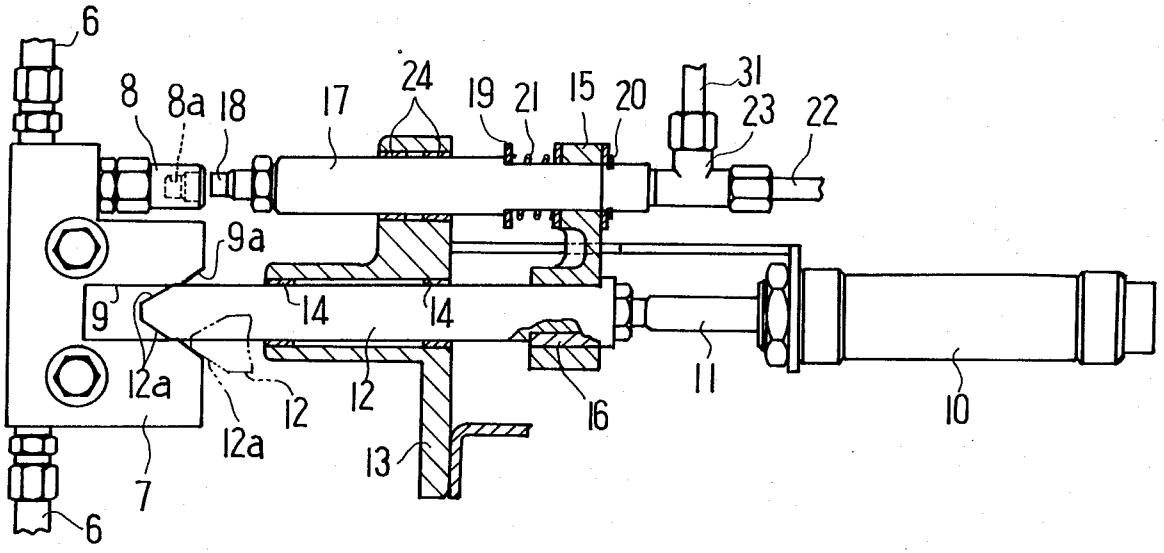

In a state of the servicing device 1 being placed where the axial center line of the locating rod 12 is slightly offset from the center of the locating guide groove 9 of the locating guide unit 7, for example as shown in FIG. 4, the solenoid-operated valve 30 is energized to operate the cylinder 10 in such a way that the locating rod 12 fixed to the piston rod 11 is advanced toward the locating guide unit 7 while being guided by the guide bracket 13, thereby allowing the tapered end of the locating rod 12 to engage with the tapered portion 9*a* of the locating guide groove 9, as shown by dash-and-dot line in FIG. 5. As the locating rod 12 advances further together with the piston rod 11, a component of force which results from contacting action of the tapered portion 12*a* of the locating rod 12 with the tapered portion 9*a* of the locating guide groove 9 and is directed in a horizontal direction acts to move the locating rod 12, therefore the entire servicing device 1 to which it is fixed, in the same direction as the component until the locating rod 12 engages with the locating guide groove 9 of the locating guide unit 7 as shown by full line in FIG. 5. To permit such free movement of the servicing device 1, the brake therefor must be kept released during such operation.

Figure 6:
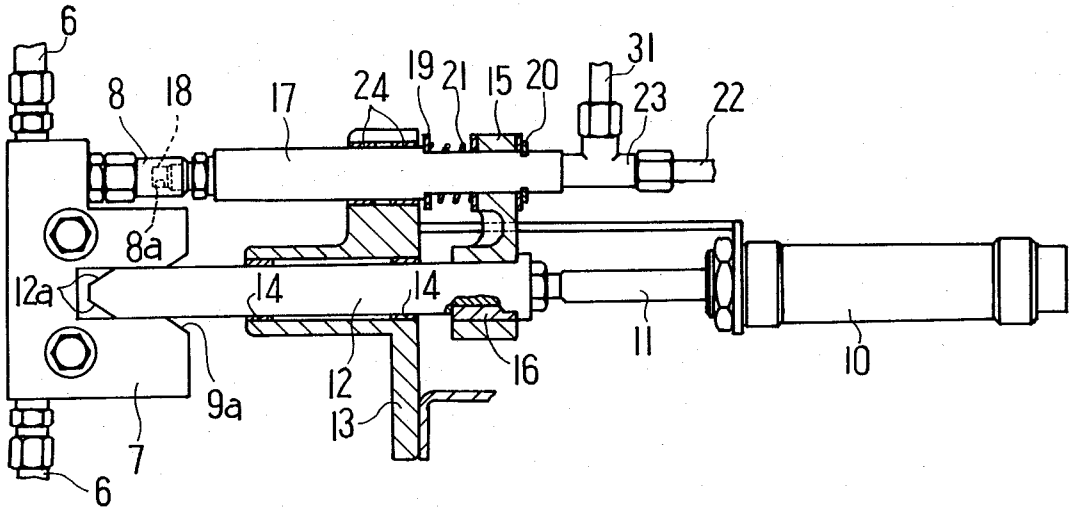

Though the communicating member 17 is advanced together with the locating rod 12 via the supporting bracket 15, the spring 21 and the flange 19, the plug connector 18 fixed at the end of the communicating member 17 is still clear of the stationary socket connector 8 as shown in FIG. 5 when the locating rod 12 has just engaged with the locating guide groove 9. With further advancement of the locating rod 12 along the locating guide groove 9, the plug connector 18 engages with the recessed portion 8*a* in the socket connector 8 as shown in FIG. 6. When the locating rod 12 is moved still further toward its advanceend position, the supporting bracket 15 is then moved sliding over the communicating member 17 while compressing the spring 21. Therefore, the plug connector 18 is urged further until a complete fit thereof in the socket connector 8 by the biasing pressure imparted by the compressed spring 21. Accordingly, a valve (not shown) incorporated in the stationary socket connector 8 is caused to open and the plug connector 18 is held securely and airtightly within the stationary counterpart 8. As a result, compressed air in the supply pipe 6 is allowed to be fed through the coupled connectors 8, 18, the air passageway 17*a* in the communicating member 17, the T-joint tube 23 and the flexible tube 22, to various pneumatic devices (not shown) in the servicing device 1, where supplied air is consumed as the medium for servicing operation. On the other hand, when communication is established at the connectors 8, 18, part of the compressed air is supplied via the flexible tube 31 and the check valve 28 to the reservoir 29 for refilling it with compressed air.

In this embodiment, since force to fit the plug connector 18 into the stationary connector 8 is not provided directly by the action of the cylinder 10, but by the biasing pressure of the compression spring 21, coupling of the connectors may be accomplished with no damaging shock.

Figure 7:
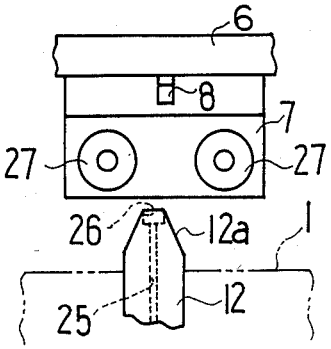
FIGS. 7 and 8 are simplified plan views showing a modified embodiment of apparatus according to the invention.
Figure 8:
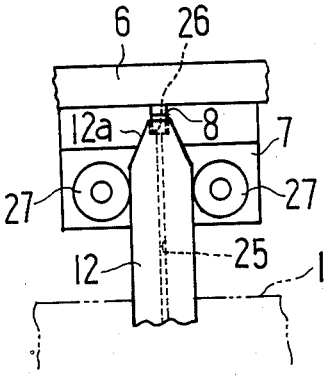

Another embodiment of apparatus according to the invention is illustrated in FIGS. 7 and 8. This embodiment differs from the previous one in that the communicating member is constructed integrally with the locating rod 12. Namely, the locating rod 12 has an axial passageway 25 formed therethrough and a recessed portion 26 at the tip end thereof which serves as a movable connector and is engageable with the stationary connector 8 on the fluid supply pipe 6. Furthermore, the locating guide unit 7, which includes a pair of locating guide rollers 27 spaced apart to form an opening whose width is slightly larger than the diameter of the non-tapered portion of the locating rod 12, is disposed in front of the stationary connector 8.

In this embodiment of apparatus of the invention, even if the servicing device 1 is stopped at an offset position (FIG. 7), advancement of the locating rod 12 toward the locating guide unit 7 followed by engagement of the tapered portion 12*a* of the locating rod 12 with either of the locating guide rollers 27 produces at the point of such engagement a reactional force which acts to move the servicing device 1 in a horizontal direction (rightwardly in case of the position shown in FIG. 7), thus regulating the position of the servicing device 1 where the mating connectors are to be coupled. Further advancement of the locating rod 12 while being guided by the rollers 27 allows the recessed portion 26 to be coupled with the stationary connector 8, thereby making a communication between the fluid supply pipe 6 and the servicing device 1.

Figure 9:
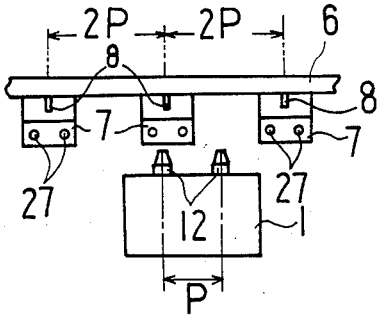
FIG. 9 is a plan view showing still another modified embodiment of apparatus according to the invention.

It is to be understood that the above embodiments are illustrated only by way of examples and that various changes in the form and construction in the details may be resorted without departing from the spirit and scope of the invention. For example, as shown in FIG. 9, it may be contemplated that a plural number "n" of locating rods 12 ("two" in the case of the embodiment shown in FIG. 9) are juxtaposed in the servicing device 1 at a spindle pitch "P" or station-to-station distance and the locating guide units 7 and the stationary connectors 8 are disposed along the fluid supply pipe 6 at intervals corresponding to "n" times the spindle pitch "P" (or "n×P").

Thus, according to the embodiments of apparatus of the present invention, wherein the movable connector to be coupled with the stationary connector provided on the supply source of compressed air or vacuum can be moved by a single actuator and is arranged in such a way that it can be moved integrally with the locating member which is adapted to position the servicing device by engaging with the locating guide member disposed on the side of the fluid supply source, locating the servicing device and coupling between the stationary connector on the fluid supply source and the movable connector on the servicing device can be effected by a single action of a single actuator, therefore with a higher degree of accuracy and reliability than heretofore. Furthermore, in comparison with the prior art which uses separate actuators or devices for locating the servicing device and coupling of connectors, the present invention can present advantages in reduction of apparatus cost, ease of maintenance and increased reliability in operation due to simplicity in construction of the apparatus.

What we claim is:

1. An apparatus for locating a servicing device which is supported movably along a parent textile machine, such as a spinning frame, including a plurality of stations and may stop at any designated station of said parent machine to perform a servicing operation, such as yarn piecing, package doffing or cleaning, at said designated station by use of a fluid medium, such as compressed air or vacuum, which may be supplied from any source of such fluid disposed along said plurality of stations separately from said servicing device, said apparatus comprising, on one hand, on said parent textile machine:

a stationary connector means arranged for each of said stations of said parent machine at intervals corresponding to the station-to-station distance and each communicating with said source of fluid;

a locator guide member disposed adjacently of each of said stationary connector means, and said apparatus comprising, on the other hand, on said servicing device;

an actuator means;

a locator member movable by said actuator means toward and away from the respective of said locator guide members and having an end portion engageable therewith;

a communicator member having a conduit formed therethrough and movable together with said locator member by said actuator means; and a movable connector means fixed to said communicator member in communication with said conduit thereof and engageable with each of said stationary connector means.

2. An apparatus as set forth in claim 1, wherein said movable connector means is so positioned that it is still clear of said stationary connector means when said locator member has just engaged with said locator guide member.

3. An apparatus as set forth in claim 2, further comprising a spring means which is so arranged that movement of said locator member by said actuator means is transmitted to said communicator member via said spring.

4. An apparatus as set forth in claim 3, wherein said actuator means includes an air-operated cylinder-and-piston assembly.

5. An apparatus as set forth in claim 1, wherein said locator guide member has a locator guide groove formed therein and providing an open side into which said locator member may be received and having a tapered portion at said open side thereof for engagement by said locator means.

6. An apparatus as set forth in claim 5, wherein said movable connector means is so positioned that it is still clear of said stationary connector means when said locator means has just engaged said tapered portion of said locator guide groove.

7. An apparatus as set forth in claim 6, further comprising a spring means which is so arranged that movement of said locator member by said actuator means is transmitted to said communicator member via said spring means.

8. An apparatus as set forth in claim 7, wherein said actuator means includes an air-operated cylinder-and-piston assembly.

9. An apparatus for locating a servicing device which is supported movably along a parent textile machine, such as a spinning frame, including a plurality of stations and may stop at any designated station of said parent machine to perform a servicing operation, such as yarn piecing, package doffing or cleaning, at said designated station by use of a fluid medium, such as compressed air or vacuum, which may be supplied from any source of such fluid disposed along said plurality of stations separately from said servicing device, said apparatus comprising, on one hand, on said parent textile machine:

a stationary connector means arranged for each of said stations of said parent machine at intervals corresponding to the station-to-station distance and each communicating with said source of fluid;

a locator guide member disposed adjacently to each of said stationary connector means, and said apparatus comprising, on the other hand, on said servicing device;

an actuator means; and a locator member movable by said acutator means into and out of engagement with the respective of said locator guide members and having a conduit formed therethrough and a movable connector portion at an end thereof engageable with the respective of said stationary connector means.

10. An apparatus as set forth in claim 9, wherein each of said locator guide members includes a pair of rollers spaced apart from each other.

11. An apparatus for locating a servicing device which is supported movably along a parent textile machine, such as a spinning frame, including a plurality of stations and may stop at any designated station of said parent machine to perform a servicing operation, such as yarn piecing, package doffing or cleaning, at said designated station by use of a fluid medium, such as compressed air or vacuum, which may be supplied from any source of such fluid disposed along said plurality of stations separately from said servicing device, said apparatus comprising, on one hand, on said servicing device:

actuator means;

a plural number "n" of locator members moved by said actuator means back and forth and having a conduit formed therethrough and a movable connector portion at an end thereof, said apparatus comprising, on the other hand, on said parent textile machine;

a stationary connector means arranged along said parent machine at each interval corresponding to "n" times the station-to-station distance and each communicating with said source of fluid and engageable with said movable connector portion; and a locator guide member disposed adjacently of each of said stationary connector means and engageable with any one of said locator members.

* * * * *